US005296130A

United States Patent [19]

Kriz et al.

[11] Patent Number: 5,296,130

[45] Date of Patent: Mar. 22, 1994

[54] HYDROCRACKING OF HEAVY ASPHALTENIC OIL IN PRESENCE OF AN ADDITIVE TO PREVENT COKE FORMATION

[75] Inventors: Jaroslav F. Kriz, Nepean; Marten Ternan, Kanata, both of Canada

[73] Assignee: Energy Mines and Resources Canada, Ottawa, Canada

[21] Appl. No.: 1,300

[22] Filed: Jan. 6, 1993

[51] Int. Cl.[5] ..... C10G 47/22; C10G 45/00; C10G 9/16

[52] U.S. Cl. ..... 208/107; 208/48 AA; 208/209

[58] Field of Search ..... 208/108, 127, 59, 112, 208/50, 107, 48 AA, 209; 502/247; 252/431

[56] References Cited

U.S. PATENT DOCUMENTS 3,849,087 11/1974 Arakawa et al. ..... 48/214
4,178,227 12/1979 Metrailer et al. ..... 208/50
4,226,742 10/1980 Bearden et al. ..... 252/431
4,295,995 10/1981 Bearden, Jr. et al. ..... 252/431
4,326,991 4/1982 Asaoka et al. ..... 252/432
4,357,229 11/1982 Bearden et al. ..... 208/10
4,391,700 7/1983 Billon et al. ..... 208/86
4,424,142 1/1984 Asaoka et al. ..... 502/84
4,557,821 12/1985 Lopez et al. ..... 208/108
4,581,127 4/1986 Varghese ..... 208/143
4,592,827 6/1986 Galiasso et al. ..... 208/59

*Primary Examiner*—R. Bruce Breneman
*Assistant Examiner*—Bekir L. Yildirim

[57] ABSTRACT

In a process for upgrading heavy asphaltenic oil, a feed slurry of a heavy asphaltenic oil and less than 10 ppm of molybdenum, e.g. molybdenum naphthenate, is contacted with a hydrogen-rich gas in a hydroconversion zone at hydrocracking conditions to convert at least a portion of said heavy oil to lower boiling products. This is achieved with minimum coke formation under moderate processing conditions.

2 Claims, 2 Drawing Sheets

HYDROCRACKING OF HEAVY ASPHALTENIC OIL IN PRESENCE OF AN ADDITIVE TO PREVENT COKE FORMATION

FIELD OF THE INVENTION

This invention relates to the treatment of hydrocarbon oils, and more particularly, to the hydrotreating of heavy asphaltenic oils in the presence of an additive to prevent coke formation.

DESCRIPTION OF THE PRIOR ART

Hydrocracking processes for the conversion of heavy hydrocarbon oils to light and intermediate naphthas of good quality for reforming feedstocks, fuel oil and gas oil are well known. These heavy hydrocarbon oils can be such material as petroleum crude oils, atmospheric tower bottoms products, vacuum tower bottoms products, heavy cycle oils, shale oils, coal-derived liquids, crude oil residua, topped crude oils and heavy bituminous oils extracted from oil sands. Of particular interest are asphaltenic oils which contain a large portion of material boiling above 525° C. equivalent atmospheric boiling point.

As the reserves of conventional crude oils decline, these heavy asphaltenic oils must be upgraded to meet the demands. In this upgrading, the heavier material is converted to lighter fractions and most of the sulphur, nitrogen and metals must be removed.

This has typically been done by a coking process, such as delayed or fluidized coking, or by a hydrogen addition process such as thermal or catalytic hydrocracking. The distillate yield from the coking process is about 70 wt % and this process yields a significant amount of low-BTU gas and coke as byproduct.

Work has also been done on an alternative processing route involving hydrogen addition at high pressures and temperatures and this has been found to be quite effective. In thermal hydrocracking, the major problem is coke or solid deposition in the reactor, especially when operating at relatively low pressure and this can result in costly shut-downs. Higher pressure reduces reactor fouling but plant operations at high pressure involve higher capital and operating costs.

During hydrocracking, the coke forms when cracked intermediates are reconstituted into large polymers. This phenomenon can be observed microscopically because it is often accompanied by the appearance of anisotropic mesophase spheres which grow through coalescence and ultimately form coke. A variety of molecular types can contribute to coke formation although the large molecules, which are present in heavy and residual oils but absent in gas oils, have the highest coking propensity.

When hydroprocessing is applied as the primary upgrading step, the key role of hydrogen is to prevent coke formation. This requires effective hydrogen transfer to the unstable species so that the chain of events involving molecular growth or coalescence is interrupted by saturation. Typically, the maximum conversion of heavy asphaltenic oil depends on the maximum operating temperature that can be applied without causing reactor coke formation. The higher is the coking propensity of the feedstock, the more effective must be the hydrogen transfer required to achieve comparable conversions. This can be established by further increasing the hydrogen pressure or by using effective catalysts or additives.

It has been well established that mineral matter present in the feedstock plays an important role in coke deposition. Chervenak et al., U.S. Pat. No. 3,775,296 shows that feed containing high mineral content (3.8 wt %) has less tendency to form coke in the reactor than feed containing low mineral matter (<1 wt %). The addition of coke carriers was proposed in Schuman et al. U.S. Pat. No. 3,151,057, who suggested the use of "getters" such as sand, quartz, alumina, magnesia, zircon, beryl or bauxite. It has been shown in Ternan et al., Canadian Patent 1,073,389 and Ranganathan et al., U.S. Pat. No. 4,214,977 that the addition of coal and coal-based catalyst results in the reduction of coke deposition during hydrocracking.

Compounds which are not necessarily effective in conventional situations such as gas phase hydrogenation reactions, may be very effective additives as coke inhibitors.

Since most of the internal surface area of porous solids is not accessible to very large molecules, only the external particle surface area of catalytic inhibitors may be effective in slurry reaction systems. Accordingly, particle size and dispersion may in many instances control the concentration of inhibitor that is required. Oil-soluble organic metallic compounds have been used in the past and these invariably have decomposed to sulphides under reaction conditions, which can reach bulk dispersion comparable to the dispersion within highly porous supports. This allows catalytic activity to be observed at relatively low concentrations.

For instance, Varghese U.S. Pat. No. 4,581,127 describes a method to control the aging of catalysts useful in the processing of hydrocarbon oils in which a metal component is added to the feedstock. This additive is used in amounts of typically 100 to 200 ppm, and the method does not apply to asphaltenic oils.

Bearden et al U.S. Pat. No. 4,226,742 describes a process for catalytic hydroconversion of heavy hydrocarbon oils in which an oil-soluble metal compound is added to the charge stock, this metal compound being converted to a catalyst within the charge stock. This oil-soluble metal compound may be a molybdenum compound which is preferable added in an amount of about 50–300 ppm.

It is the object of the present invention to find a coke suppressing additive which can be added to the asphaltenic oil feedstock in essentially trace amounts.

SUMMARY OF THE INVENTION

According to the present invention, it has now been discovered that molybdenum naphthenate is a highly effective coke suppressing additive when added to asphaltenic oil feedstocks in very small amounts of less than 10 ppm, typically less than 5 ppm. The molybdenum naphthenate can be added to the feedstock as a disposable additive. It has the effect of permitting higher conversions by permitting increased reactor temperatures or permitting lower hydrogen pressures thereby making equipment less expensive. It also has the advantage that the amount of additional solids in the unconverted residuum is minimal.

Thus, the present invention in its broadest aspect relates to a hydroconversion process in which a feed slurry comprising a heavy asphaltenic oil and up to 10 ppm of molybdenum naphthenate is contacted with a hydrogen-containing gas in a hydroconversion zone under conversion conditions to convert at least a portion of the oil to lower boiling products and thereby produce a hydroconverted oil. The molybdenum additive can be any soluble molybdenum compound which leads to the formation of highly dispersed $MoS_2$ under the hydroconversion conditions. A particularly preferred molybdenum compound is molybdenum naphthenate.

The process of the invention substantially prevents the formation of carbonaceous deposits in the reaction zone. These deposits, which may contain quinoline and toluene insoluble organic material, mineral matter, metals, sulphur and benzene-soluble organic material will hereinafter be referred to as "coke" deposits. The deposits typically form on the walls of the reactor and on downstream equipment.

The process of this invention is particularly well suited for the treatment of heavy asphaltenic oils having at least 50% by weight of which boils above 525° C. and at least 10% by weight of asphaltenes. It can be operated at quite moderate pressure, e.g. in the range of 3.5 to 24 MPa, preferably about 6–18 MPa, without coke formation in the hydrocracking zone. The reactor temperature is typically in the range of 350° to 600° C., with a temperature of 400° to 460° C. being preferred. The LHSV is typically in the range of 0.1 to 3.0 $h^{-1}$, preferably 0.1 to 1.0 $h^{-1}$.

Although the hydrocracking can be carried out in a variety of known reactors of either up or down flow, it is particularly well suited to a tubular reactor through which feed and gas move upwardly. The effluent from the top is preferably separated in a hot separator and the gaseous stream from the hot separator can be fed to a low temperature-high pressure separator where it is separated into a gaseous stream containing hydrogen and less amounts of gaseous hydrocarbons and a liquid product stream containing light oil product.

According to a preferred embodiment, the molybdenum naphthenate is mixed with a heavy asphaltenic oil feed and pumped along with hydrogen through a vertical reactor. The liquid-gas mixture from the top of the hydrocracking zone can be separated in a number of different ways. One possibility is to separate the liquid-gas mixture in a hot separator kept between 200°–460° C. and at the pressure of the hydrocracking reaction. The heavy hydrocarbon oil product from the hot separator can either be recycled or sent to secondary treatment.

The gaseous stream from the hot separator containing a mixture of hydrocarbon gases and hydrogen is further cooled and separated in a low temperature-high pressure separator. By using this type of separator, the outlet gaseous stream obtained contains mostly hydrogen with some impurities such as hydrogen sulphide and light hydrocarbon gases. This gaseous stream is passed through a scrubber and the scrubbed hydrogen may be recycled as part of the hydrogen feed to the hydrocracking process. The hydrogen gas purity is maintained by adjusting scrubbing conditions and by adding make up hydrogen.

The liquid stream from the low temperature-high pressure separator represents the light hydrocarbon oil product of the present process and can be sent for secondary treatment.

BRIEF DESCRIPTION OF THE DRAWINGS

For a better understanding of the invention, reference is made to the accompanying drawings which illustrates diagrammatically a preferred embodiment of the present invention.

Figure 1:
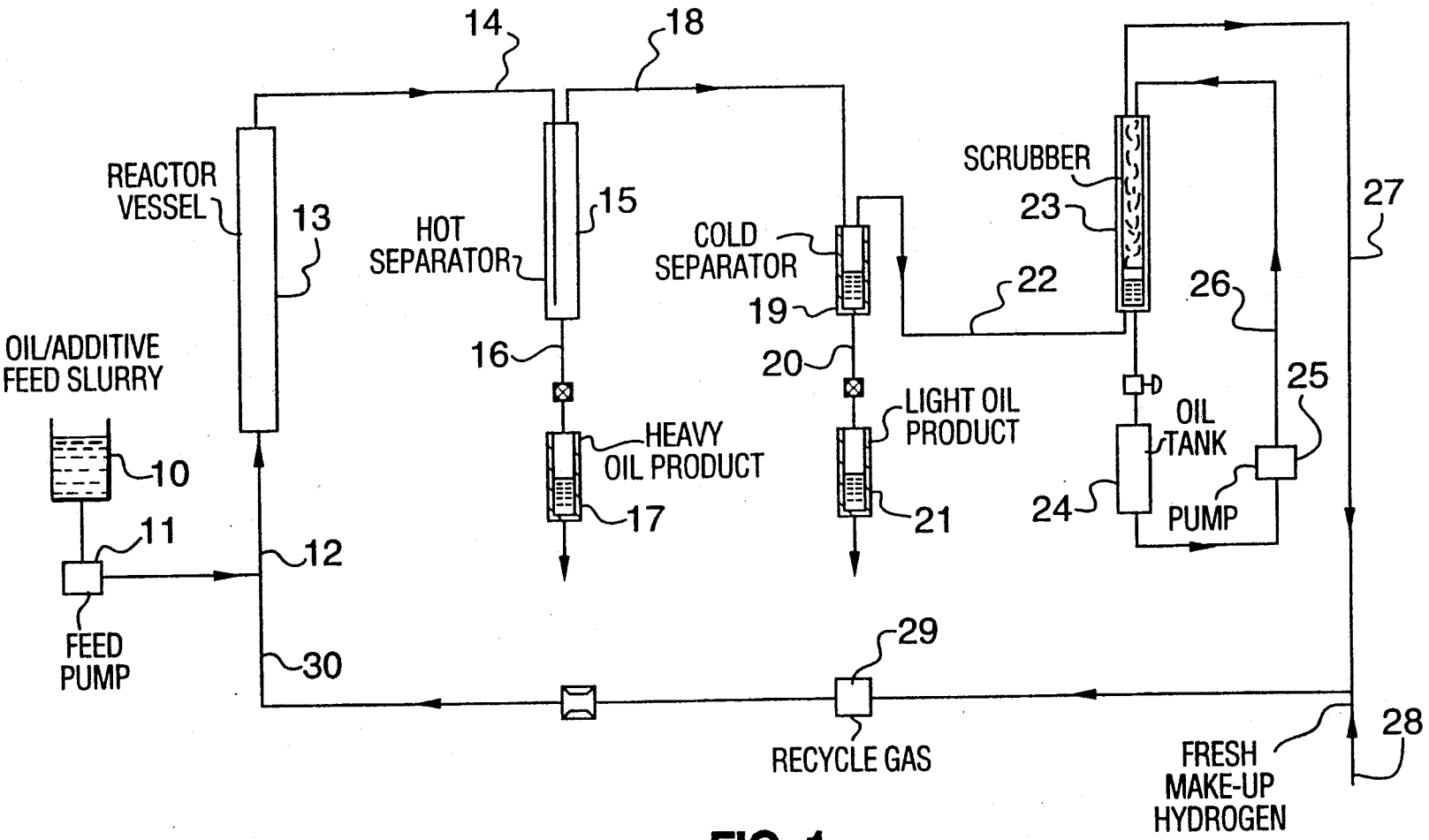
FIG. 1 is a schematic flow diagram showing a hydrocracking process.

In the hydrocracking process as shown in FIG. 1, the molybdenum additive is mixed together with a heavy asphaltenic oil feed in a feed tank 10 to form a slurry. This slurry is pumped via feed pump 11 through inlet line 12 into the bottom of an empty tower 13. Recycled hydrogen and make up hydrogen from line 30 is simultaneously fed into the tower through line 12. A gas-liquid mixture is withdrawn from the top of the tower through line 14 and introduced into a hot separator 15. In the hot separator the effluent from tower 13 is separated into a gaseous stream 18 and a liquid stream 16. The liquid stream 16 is in the form of heavy oil which is collected at 17.

The gaseous stream from hot separator 15 is carried by way of line 18 into a high pressure-low temperature separator 19. Within this separator the product is separated into a gaseous stream rich in hydrogen which is drawn off through line 22 and an oil product which is drawn off through line 20 and collected at 21.

The hydrogen rich stream 22 is passed through a packed scrubbing tower 23 where it is scrubbed by means of a scrubbing liquid 24 which is cycled through the tower by means of pump 25 and recycle loop 26. The scrubbed hydrogen rich stream emerges from the scrubber via line 27 and is combined with fresh make up hydrogen added through line 28 and recycled through recycle gas pump 29 and line 30 back to tower 13.

DESCRIPTION OF THE PREFERRED EMBODIMENTS

Preferred embodiments of this invention are illustrated by the following non-limiting examples.

EXAMPLE 1

The feedstock used for this test was an Athabasca bitumen having the properties given in Table 1 below:

TABLE 1

| Test | Value |
|---|---|
| API gravity, °API | 8.1 |
| Relative density, kg · $m^{-3}$ (15° C.) | 1013 |
| Viscosity | |
| 100° C., cSt | 195.44 |
| 130° C., cSt | 58.25 |
| 150° C., cSt | 31.24 |
| Distillation resid, 525° C+. wt % | 52.4 |
| Pentane insolubles, wt % | 16.50 |
| Toluene insolubles, wt % | 0.82 |
| Microcarbon residue, wt % | 14.30 |
| Carbon, wt % | 83.30 |
| Hydrogen, wt % | 10.90 |
| Sulphur, wt % | 4.62 |
| Ash, wt % | 0.83 |
| Nitrogen, wt % | 0.56 |
| | (0.59) |
| Metals, ppm | |
| Si | 1661 |
| Al | 1081 |
| Fe | 700 |
| Ti | 209 |
| V | 197 |
| Ca | 130 |
| K | 119 |
| Ni | 74 |

TABLE 1-continued

| Test | Value |
|---|---|
| Na | 68 |
| Mg | 67 |

A feedstock was prepared in a hopper by mixing Athabasca bitumen with a predetermined amount of molybdenum naphthenate. The feedstock was then mixed with pure hydrogen of a specified pressure at STP flow rate of about 840 l/l or 5,000 scf/bbl and pumped continuously up through a high pressure continuous flow tubular reactor system at an apparent liquid space velocity of 1 $h^{-1}$. One experimental run was completed in eight hours including start-up and shutdown. At start-up, the system was first pressurized with hydrogen and under hydrogen flow heated to 300° C. Then, while maintaining conditions, the feedstock was pumped in for one hour. Subsequently, the temperature was elevated to a predetermined level in about 0.5 hour by supplying constant power to reactor heaters. The temperature level was then maintained for 4.5 hours during which changes in reactor temperature profiles were monitored and two liquid product samples were collected at 1.5 hours and 3 hours. At shutdown, the heaters were turned off and, when cooled to 390° C., the reactor was isolated from the flow system and its fluid content was drained by using the pressure of the residual gas. Thereafter, the entire solid residue of the reservoir was carefully collected.

Figure 2:
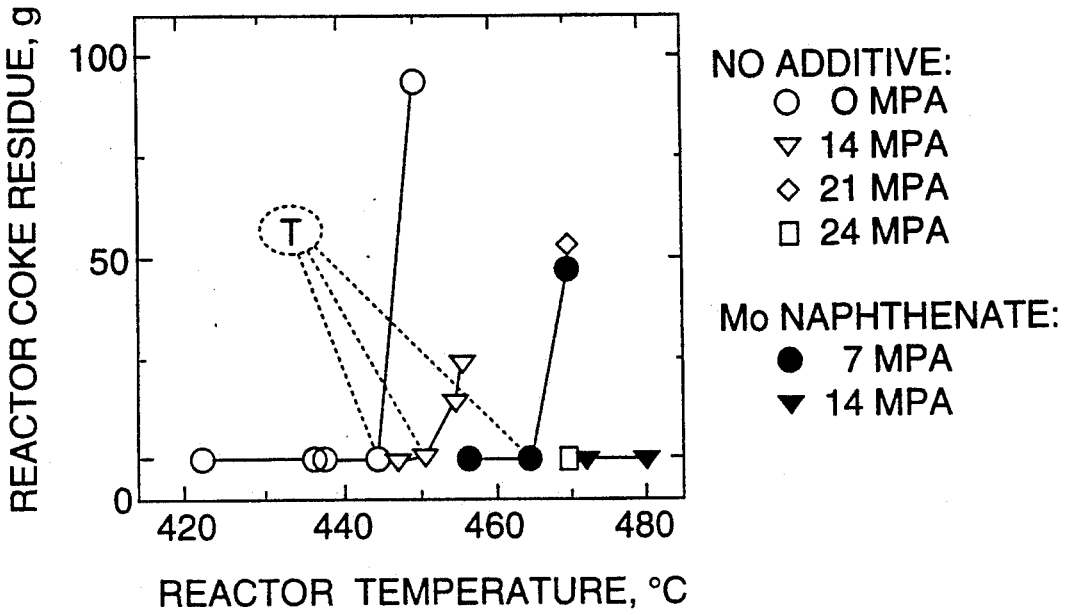
FIG. 2 is a plot of coke residue amount as a function of temperature.

The reactor was operated at reactor temperatures between 420° and 480° C., molybdenum naphthenate was added in amounts between 1 and 100 ppm and hydrogen pressures were monitored between about 7 and 24 MPa. The results obtained are shown in FIGS. 2 and 3.

The ability of an additive to suppress coke can be determined by finding the threshold point of coking. For a given feedstock oil, these points depend on operating conditions, i.e. temperature and pressure if flow rates are kept constant. When the experimental conditions are near the threshold of coking, coke just begins to form. Therefore, the operation becomes more difficult and usually a very small amount of reactor coke deposit is found after shutdown. However, should a higher temperature or lower hydrogen pressure be used, substantially more coke would be found, often causing premature shutdown. An additive which is capable of suppressing coke will shift the threshold of coking to either higher temperatures or lower pressures. This is clearly shown in FIG. 2.

The ability of an additive to suppress coke can thus be quantitatively described by using operating conditions as variables to reach the threshold of coking. For example, the relationship between temperature and additive concentration at constant pressure, or the relationship between hydrogen pressure and additive concentration at constant temperature can be used. The latter is shown in FIG. 3. An important difference between FIGS. 2 and 3 is that the only points marked by "T" emerge as threshold coking situations from FIG. 2, whereas all points in FIG. 3 pertain to the threshold of coking.

Figure 3:
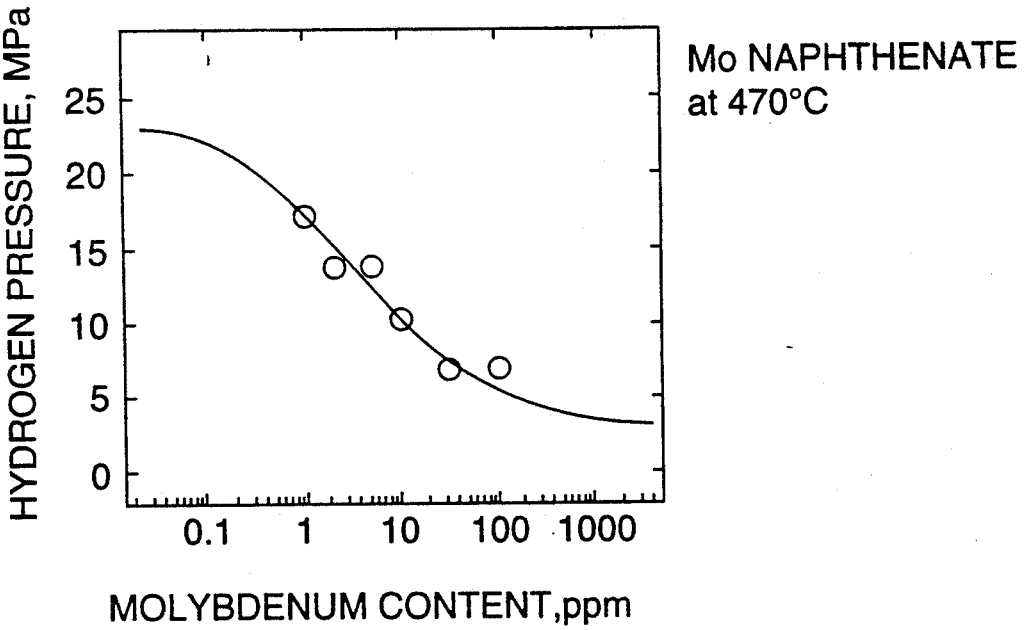
FIG. 3 is a plot of hydrogen pressure as a function of molybdenum content.

FIG. 3 illustrates the ability of molybdenum naphthenate to substitute hydrogen pressure in suppressing coke formation. Thus, it will be seen that while about 24 MPa hydrogen is needed to suppress coke in the feedstock alone, only about 14 MPa was required in the presence of 3 ppm molybdenum and only about 12 MPa was necessary in the presence of 5 ppm molybdenum, when added as molybdenum naphthenate. The ability of this additive to suppress coke quickly diminishes with pressure and disappears at about 4 MPa.

Without exception, all yields obtained for the test carried out with less than 10 ppm molybdenum were indistinguishable when the feedstock oil alone was used. Usually, the extent of hydrogenation, cracking and, especially, sulphur removal are enhanced as a consequence of the catalytic effect of molybdenum. It is evident that there was no other catalytic activity to associate with the presence of molybdenum except coke suppression.

For a typical hydrocracking arrangement using either fixed or an ebullated catalyst bed, the catalyst requirement can be expressed in terms of the amount needed to process a given volume of feedstock in a given time. For molybdenum contained in commercial catalyst extrudates, pellets, etc. this requirement is typically within the order of magnitude of $10^{-1}$ to $10^{-2}$kg.$L^{-1}$.$h^{-1}$. In this situation, 10 ppm of molybdenum mixed in the oil feedstock represents about $10^{-5}$ kg.$L^{-1}$.$h^{-1}$ if the liquid space velocity were 1 $h^{-1}$, which is 1,000 to 10,000 times less than typically required. It is believed that the coke precursor entities effected by molybdenum present in such low concentrations are very large relative to other typical molecules and that their participation in other than coke-forming reactions is minimal. The catalytic effect of molybdenum is therefore simply demonstrated by stabilizing these entities through hydrogen transfer so that they become less prone to further growth. It appears that such a mechanism may involve predominantly the very external surface of catalytic particles which is effectively supplied through the high dispersion. Since the total surface area remains very small because of the low metal concentration, the catalytic effects, in the conventional sense, are insignificant. However, the coke suppression activity is still very significant and it is thus obvious that the conventional indicators, such as yields, would not reveal the particular activity found in the process of this invention.

The reduced propensity for coke formation achieved by adding trace amounts of molybdenum naphthenate according to this invention allows an increase of reactor temperature, which in turn provides higher conversion than are possible without additives. Alternatively, conversions which may be achieved only at high pressures of higher than about 21 MPa without additives may be achieved according to the present invention at medium or moderate pressures as low as 10 MPa.

We claim:

1. A hydroconversion process for upgrading heavy asphaltenic oil containing at least 50% by weight of material boiling above 525° C. and at least 10% by weight of asphaltenes and containing sulphur and other impurities which comprises preparing a feed slurry of a heavy asphaltenic oil and less than 5 ppm of molybdenum in the form of an oil soluble compound which under hydroconversion conditions reacts with the sulphur in the heavy asphaltenic oil to form highly dispersed $MoS_2$ and contacting this slurry with a hydrogen-containing gas in the hydroconversion zone at hydrocracking conditions at a pressure int eh range of 6 to 18 MPa and a temperature in the range of 400° to 460° C. to convert at least a portion of said oil to lower boiling products with minimum coke formation.

2. A hydroconversion process for upgrading heavy asphaltenic oil containing at least 50% by weight of material boiling above 525° C. and at least 10% by weight of asphaltenes and containing sulphur and other impurities, which comprises preparing a feed slurry of a heavy asphaltenic oil and less than 5 ppm of molybdenum naphthenate and contacting this slurry with a hydrogen-containing gas in a hydroconversion zone at hydrocracking conditions at a pressure in the range of 6 to 18 MPa, a temperature in the range of 400° to 600° C. and a LHSV in the range of 0.1 to 1.0 $H^{-1}$ to convert at least a portion of said oil to lower boiling products with minimum coke formation.

* * * * *